US006016998A

United States Patent [19]

Allsopp

[11] Patent Number: 6,016,998

[45] Date of Patent: Jan. 25, 2000

[54] KITE STABILITY AND WEIGHT

[76] Inventor: Gerald Alexander Richard Allsopp, Flat 1, Chestnut Lodge, London Road, Chalford, Stroud, Gloucestershire GL68NW, United Kingdom

[21] Appl. No.: 08/278,335

[22] Filed: Jul. 21, 1994

[51] Int. Cl.[7] ..... A63H 27/08

[52] U.S. Cl. ..... 244/153 R

[58] Field of Search ..... 244/153 R, 33, 244/146

[56] References Cited

U.S. PATENT DOCUMENTS

| | | | |
|---|---|---|---|
| 1,432,515 | 10/1922 | Allison | 244/33 |
| 2,208,786 | 7/1940 | Astle | 244/153 R |
| 3,335,985 | 8/1967 | Neal | 244/153 R |
| 3,791,611 | 2/1974 | Babbidge | 244/33 |
| 3,806,071 | 4/1974 | Brown | 244/153 R |
| 4,216,929 | 8/1980 | Holland, Jr. | 244/153 R |
| 4,919,365 | 4/1990 | Mears | 244/33 |
| 5,000,401 | 3/1991 | Barone | 244/153 R |

FOREIGN PATENT DOCUMENTS

| | | | |
|---|---|---|---|
| 2216431 | 11/1989 | United Kingdom | 244/153 R |

*Primary Examiner*—Charles T. Jordan
*Assistant Examiner*—Tien Dinh
*Attorney, Agent, or Firm*—Young & Thompson

[57] ABSTRACT

A combination of a kite and a helium balloon wherein the whole is lighter than air so allowing the said combination to fly with or without wind.

The kite hangs from the bottom of the balloon and is secured flush with the balloon by adhesive tape. New balloons can be put on at any time using the tape. The kite has a large keel for stability and a tail.

10 Claims, 4 Drawing Sheets

KITE STABILITY AND WEIGHT

This invention relates to the use of kites and helium balloons for purposes of flight.

The invention is primarily intended for birdscaring, but could also be used for publicity purposes, for lifting objects, for recreation or for other uses where a light, cheap, stable aerial object is desired.

Normal kites are heavier than air, this means that during periods of turbulent, unstable wind conditions and during periods of still air normal kites are unable to continue flying.

Normal helium balloons rise upwards in still air, but in wind, a tethered balloon is very easily blow down until it is only a few feet from the ground. This is because it is aerodynamically unsound.

My aim is to combine the properties of kites and balloons to create an aerodynamically sound, lighter than air kite/balloon unit. I aim also to allow the use of light cheap mass-produced disposable balloons that are easily available and economical.

According to the present invention there is provided a specially designed kite onto which a balloon has been attached, in order to make the whole unit lighter than air whilst retaining good lifting aerodynamics.

The kite is similar to a traditional diamond shape but differs in crucial areas. Its nose section is longer than normal in order to facilitate its fixing to the balloon. Two tabs or ripstop nylon or similar strong material are fixed to the leading edges of the tape to the balloon. Also there is provided a very large keel to give stability in high winds. From the base of this keel the line extends to the ground. The keel (and therefore the influence of the line) extends further forward than most kite keels. This is needed to exert control of the balloon. The spars of the kite can be made of wood, plastic, fibreglass, carbon fibre or other similar material. The sail of the kite can be made of ripstop-nylon, nylon, cotton, plastic, or other suitable material.

The balloon used is a mass-produced "foil" balloon. This is in fact made of a very thin nonrubber plastic material covered by a metallic paint. The material of these balloons does not stretch as normal rubber balloons do, as a result they do not leak helium like normal rubber balloons. This enables them to remain airborne for very long periods of time. Many shapes, types and sizes of balloon could be used. Equally various shapes of kite will work, but the one described above seems the best.

The kite is conveniently secured to the balloon by means of waterproof sticky-tape, however, other methods of attachment could be used if required. Extra glue is put on the kite to enable the tape to stick better, but no glue is put on the balloon. The tape fixes the kite to the lower side of the balloon. This ensures that the balloon is forced to cut into the wind to give itself some lift. The heavier kite will naturally tend to be below the balloon in flight, so the balloon will aid the kites stability. If the balloon/kite combination does fall to the ground, due to leaking helium, or heavy raindrops increasing the weight, then the kite will be the first thing to hit the ground, thereby protecting the fragile balloon from sharp objects. When the balloon is reinstated or dries out, then the balloon/kite combination will automatically present a correct attitude to the wind, and rise automatically into the air. If there is no wind the balloon/kite combination will still rise due to it being lighter than air overall.

For a better understanding of the invention, some embodiments will now be described, by way of example, with reference to the accompanying drawings, in which.

The drawings are annotated with numbers which correspond to the following descriptions:

(1) Main body of kite.

(2) Keel of kite.

(3) Nylon line from kite to ground.

(4) Weatherproof tape covering leading edge of kite, and fixing to the balloon.

(5) Topside of "foil" helium balloon.

(6) Valve of balloon.

(7) Safety string leading from valve to main spar of kite.

(8) Tail of kite.

(9) Balloon seam.

(10) Loop for attachment of nylon line to keel.

(11) Bottomside of balloon.

(12) Tab on kite to aid adhesion of tape to balloon.

(13) Stake in the ground to which the nylon line is securely fixed.

Figure 1:
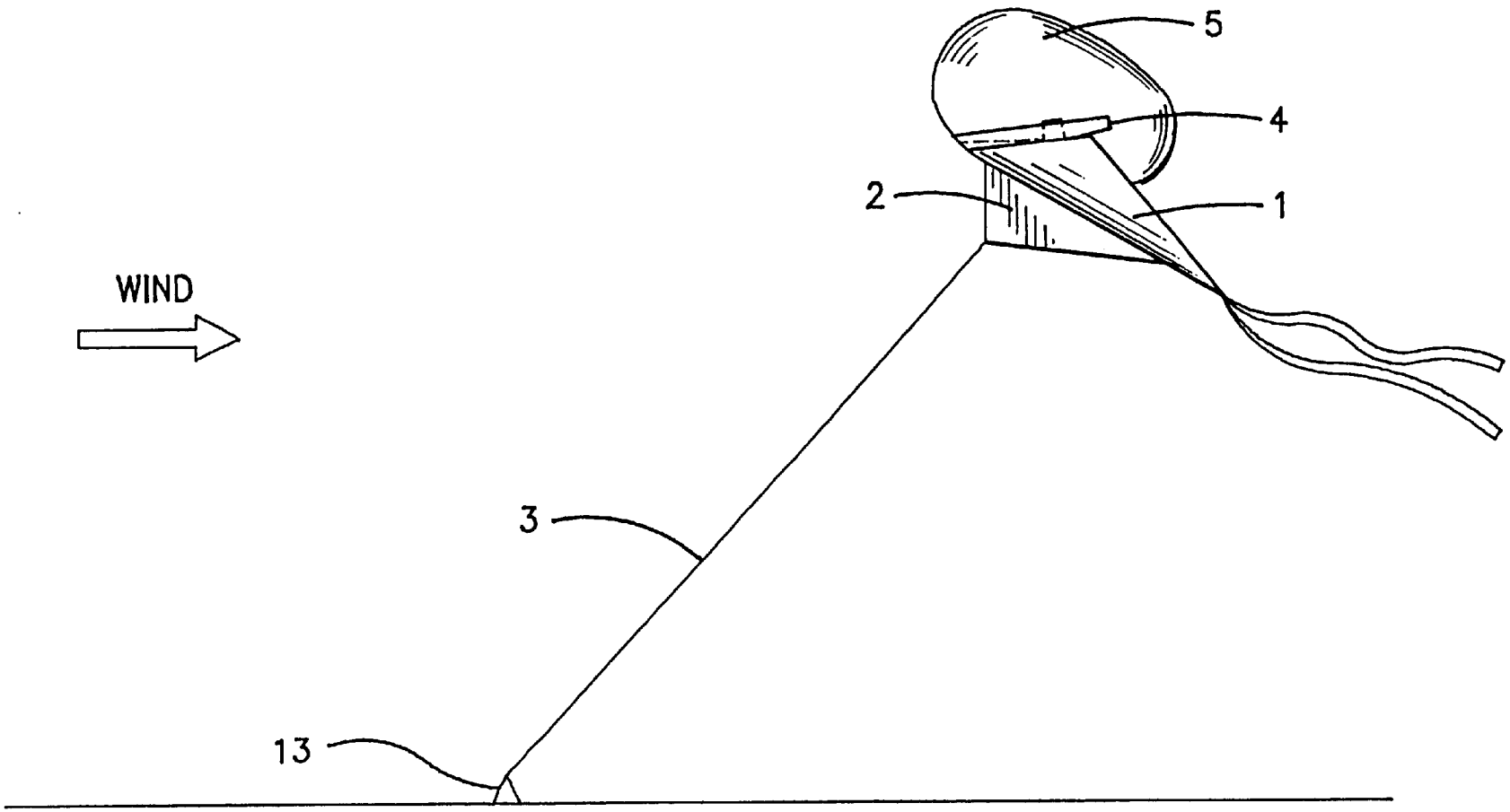
FIG. 1 is a generalised diagram of the balloon/kite unit in use with wind.

Referring first to FIG. 1. The kite/balloon unit can be seen attached to the line. The wind holds the kite (1) aloft, and is therefore unable to blow the balloon (5) to the ground. The nylon line (3) has been shortened for the purposes of the diagram.

Figure 4:
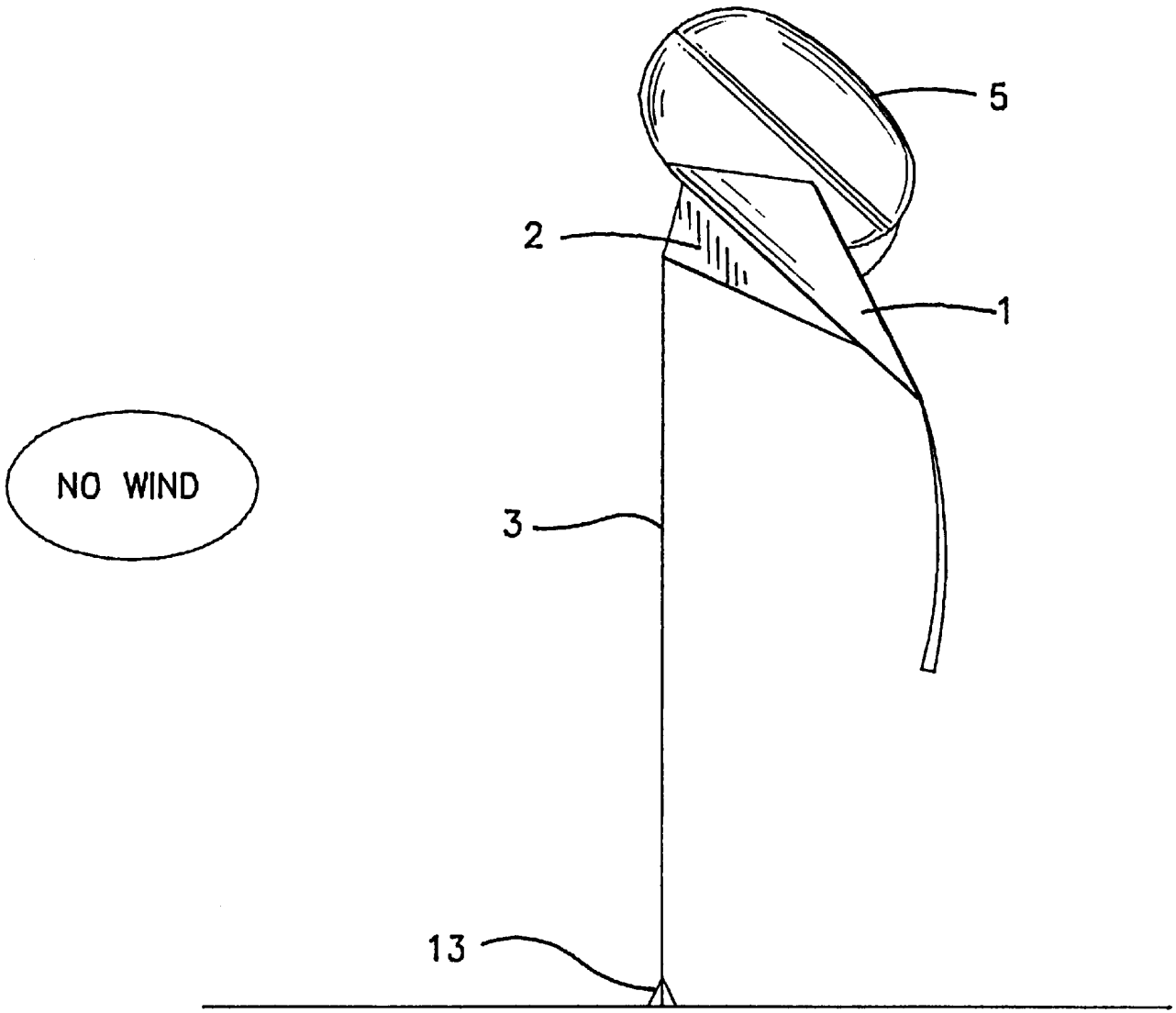
FIG. 4 shows the balloon/kite unit with no wind.

In contrast FIG. 4 shows how the balloon holds the kite up when there is no wind. The nylon line is vertical.

Figure 2:
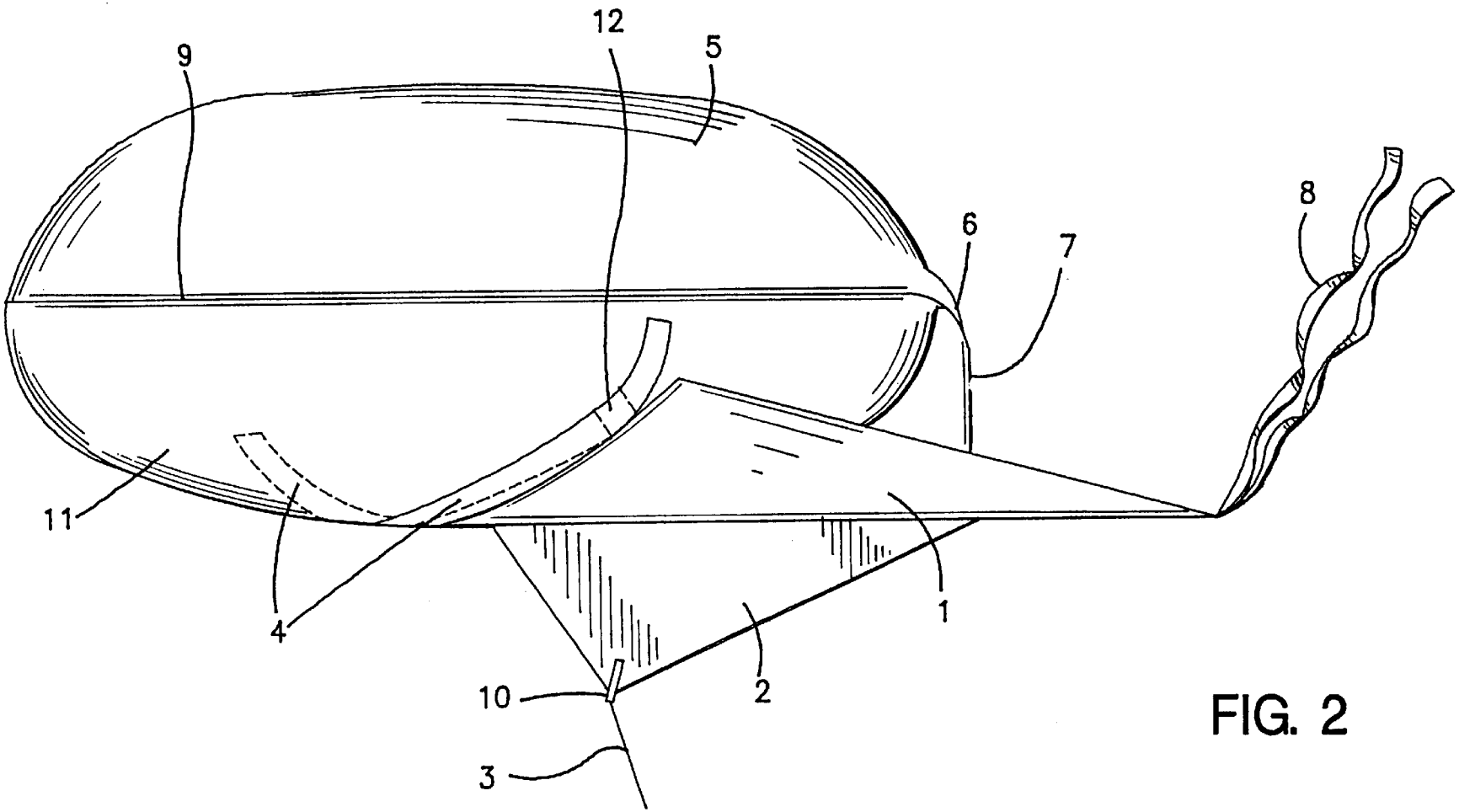
FIG. 2 is a side elevation of the balloon/kite unit.
Figure 3:
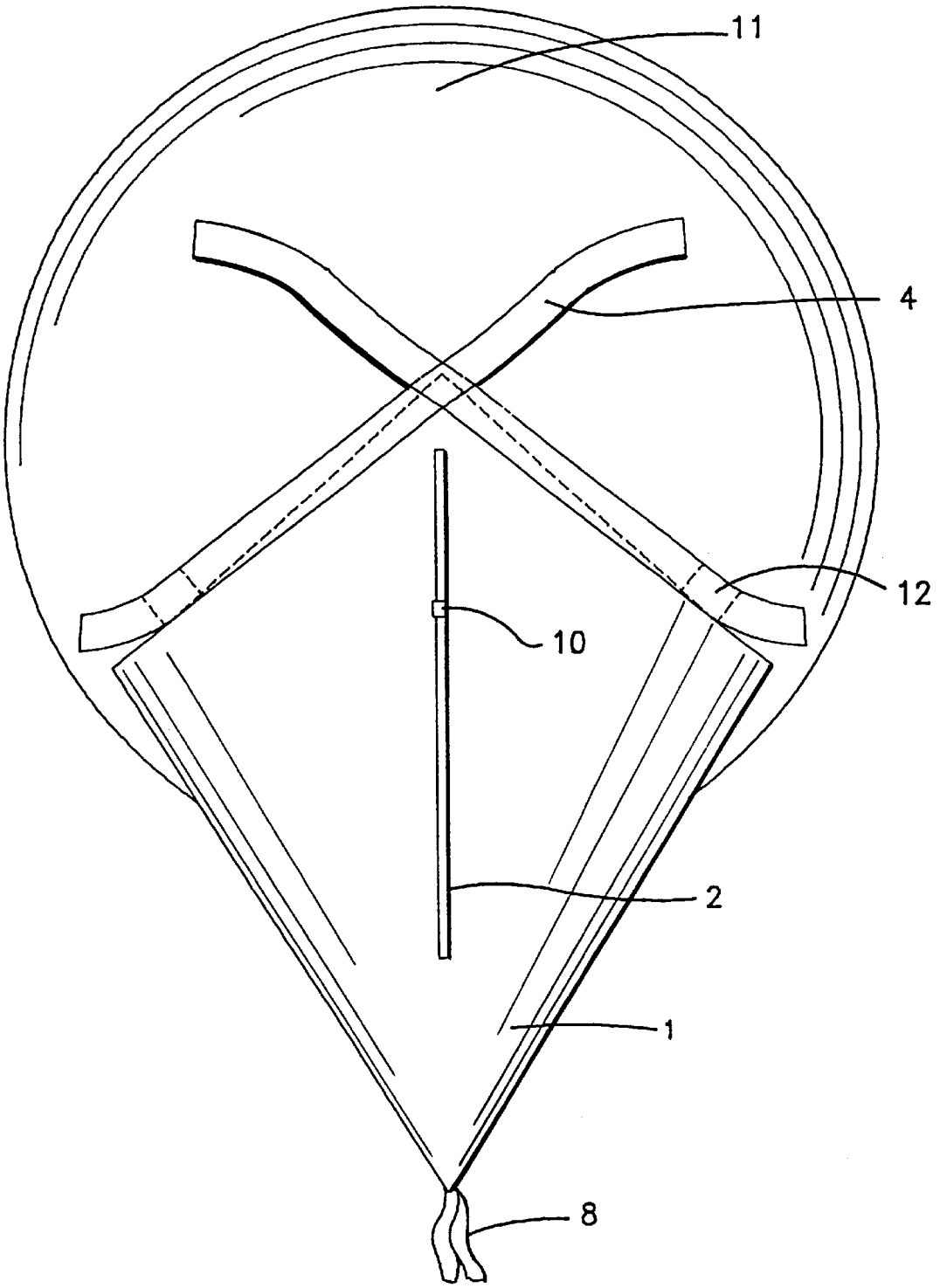
FIG. 3 is a view from the underneath of the balloon/kite unit.

FIGS. 2 and 3 show the structure of the balloon/kite unit in more detail. The main kite body (1) is attached to the underside of the balloon (11) by means of waterproof sticky tape (4). The leading edge of the kite is covered by the tape, under this is some contact adhesive to aid the bonding of the tape to the kite. No contact adhesive is needed in order for the tape to stick to the balloon. In FIG. 3 it can be seen how the two pieces of tape (4) crossover at the head of the kite. They also cover the tab (12) before sticking around the edge of the balloon. This method of sticking the tape ensures that the tape will only have sideways forces exerted on it, and it will not be peeled off by the movement of the kite as it is buffeted by the wind.

The nylon line (3) is attached to a nylon loop (10) which is strongly attached to the keel (2). The keel ensures stability in high winds. The tail (8) also aids stability.

The balloon will leak helium slowly and will occasionally need to be refilled. This can be done without removing the kite from the balloon, as the valve entrance faces away from the kite to aid filling.

The whole balloon/kite unit is sprayed with a waterproofing coating such as "Fabsil" which is normally used for waterproofing tents or clothes. This ensures that water drops roll off the balloon/kite unit very easily, so that the kite dries out quickly after rainfall. The spars of the kite are not shown in the diagram, but they crossover in the traditional kite manner and are made of light wood, plastic, carbon-fibre, or other suitable material.

I claim:

1. In the combination of a lighter-than-air balloon and a kite, the improvement comprising means fixedly securing only a forward portion of said kite to an underside of said balloon against movement of said portion of the kite relative to said underside of the balloon, a rearmost portion of said kite being spaced a substantial distance from the balloon.

2. The combination as claimed in claim 1, wherein said kite has an extending nose portion.

3. The combination as claimed in claim 1, wherein said kite has a depending keel.

4. The combination as claimed in claim 1, wherein said balloon is made of a non-stretching plastic material.

5. The combination as claimed in claim 1, wherein said balloon comprises a metallic coated plastic material.

6. The combination as claimed in claim 1, wherein said balloon is ellipsoidal.

7. The combination as claimed in claim 1, wherein said balloon is filled with helium.

8. The combination as claimed in claim 1, wherein said means comprise strips of adhesive tape, by which forward edges of said kite are secured to said underside of said balloon.

9. The combination as claimed in claim 1, wherein said kite includes at least two tabs connected to leading edges of said kite, and adhesive tape means for securing said kite to said balloon via said tabs.

10. The combination as claimed in claim 1, wherein said kite has a tail.

* * * * *